US007857429B2

(12) United States Patent
Ozaki et al.

(10) Patent No.: US 7,857,429 B2
(45) Date of Patent: Dec. 28, 2010

(54) INK JET RECORDING HEAD AND MANUFACTURING METHOD OF INK JET RECORDING HEAD

(75) Inventors: Teruo Ozaki, Yokohama (JP); Ichiro Saito, Yokohama (JP); Kenji Ono, Tokyo (JP); Satoshi Ibe, Yokohama (JP); Toshiyasu Sakai, Kawasaki (JP); Sakai Yokoyama, Kawasaki (JP); Kazuaki Shibata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 959 days.

(21) Appl. No.: 11/561,058

(22) Filed: Nov. 17, 2006

(65) Prior Publication Data

US 2007/0120902 A1 May 31, 2007

(30) Foreign Application Priority Data

Nov. 29, 2005 (JP) ..... 2005-344366

(51) Int. Cl.
*B41J 2/05* (2006.01)

(52) U.S. Cl. ..... 347/65

(58) Field of Classification Search ..... 347/61–64
See application file for complete search history.

(56) References Cited

U.S. PATENT DOCUMENTS

| | | | | |
|---|---|---|---|---|
| 4,412,224 | A * | 10/1983 | Sugitani | 347/65 |
| 4,723,129 | A | 2/1988 | Endo et al. | 346/1.1 |
| 4,740,796 | A | 4/1988 | Endo et al. | 346/1.1 |
| 2005/0179744 | A1 * | 8/2005 | Sasaki | 347/65 |

* cited by examiner

*Primary Examiner*—Matthew Luu
*Assistant Examiner*—Lisa M Solomon
(74) *Attorney, Agent, or Firm*—Fitzpatrick, Cella, Harper & Scinto

(57) ABSTRACT

An ink jet recording head includes a substrate provided with an energy generating element to generate energy used for discharging ink, a discharge port through which the ink is discharged, a supply port for supplying the ink, and an ink path formed on the substrate for making the discharge port and the supply port communicate with each other, wherein wall members forming the ink path are made of an inorganic material, and a space between adjacent ink paths is filled up by a metal layer.

6 Claims, 9 Drawing Sheets

INK JET RECORDING HEAD AND MANUFACTURING METHOD OF INK JET RECORDING HEAD

BACKGROUND OF THE INVENTION

1. Field of the Invention

The present invention relates to an ink jet recording head performing recording by discharging ink and a manufacturing method thereof.

2. Description of the Related Art

The ink jet recording systems disclosed in U.S. Pat. No. 4,723,129 and U.S. Pat. No. 4,740,796 can perform high-speed, high-density, high-accuracy, high-image-quality recording, and are suitable for colorization and compactification. A recording head that uses the ink jet recording systems to bubble ink using thermal energy for discharging the bubbled ink onto a recording medium is generally configured as follows. That is, the configuration is one in which a heating resistor for bubbling the ink and wiring to perform electric connection to the heating resistor are produced on the same substrate to use the substrate as a substrate for an ink jet recording head and further nozzles for discharging the ink are formed over the substrate.

On the other hand, various methods have been proposed as to the formation method and the material of the nozzles. One of the representative ones is the method of forming liquid chambers, discharge ports and supply ports by resin molding in advance to directly stick the molded member to the substrate. Another method is to form through-holes in the substrate to use the through-holes as supply ports, and to form the liquid chambers, the wall members of the liquid chambers and the discharge ports on the substrate using a resin by the photolithographic method so that the liquid chambers, the wall members and the discharge ports communicate with the supply ports. The latter method can perform the high-density arrangement of the discharge ports in comparison with the former method, and the latter method is presently the most popular method accordingly.

The method of forming the components of the recording head using a resin by the photolithographic method as described above is simple in manufacturing, but the method causes the following problems pertaining to the reliability thereof.

1. Because the linear expansion coefficients of the resin and the substrate, which is an inorganic material, differ from each other, the resin easily peels off from the substrate at the interface between them.

2. The resin absorbs moisture to swell, and the dimensional accuracy thereof becomes worse consequently.

Accordingly, in order to overcome the problems mentioned above, devices of changing the resin material to an inorganic material have been made.

For example, there have been proposed the method of coating an inorganic material on a substrate to form the members by the photolithographic method, and the method of forming the members by the chemical vapor deposition (hereinafter simply referred to as "CVD").

The materials used for the formation of the CVD are denser than the materials used for the coating method, and are good in the resistance property and the like to ink. Consequently, the former materials are suitable for the wall members of the liquid chambers and the material of the discharge port portions, but the CVD includes the following problems caused by the property thereof.

For example, if the following process is performed, the flow paths are completed. That is, a material to become the shapes of flow paths is formed on a substrate; an inorganic material to coat the shapes is formed by the CVD after that; discharge ports for discharging ink are then formed in the inorganic material; and the shapes are removed.

However, because a film formed by the CVD grows along the substrate and the shape material unlike the growth of the films formed by the spin coat method and the like, a dent on a groove is formed between the wall members of each flow path. Then, the thicker the thickness of the shape material (corresponding to the heights of the ink flow paths) is, the deeper the grooves become. Consequently, when ink adheres to the grooves at the time of ink discharging, or at the time of cleaning the discharge ports of a head, the adherence exerts a bad influence upon the discharge of ink.

Moreover, also the following problem exists. That is, when the wall members of the liquid chambers are formed, it is better to thicken the thickness of the film made to grow by the CVD in order to give the film a certain measure of strength. However, when the film formed on the shape material is too thick, the thicknesses of the discharge ports become too thick when the discharge ports are formed. Consequently, a problem is caused in the discharge performance in turn.

The present invention was made in consideration of the problems mentioned above. The present invention provides an ink jet recording head that settles the problem of the grooves between the walls of the ink flow paths which problem is caused when the wall members of the ink flow paths are made of an inorganic material, and that includes a flattened discharge port surface. Moreover, the present invention provides an ink jet recording head equipped with the wall members of ink flow paths that have a sufficient mechanical strength.

SUMMARY OF THE INVENTION

According to an aspect of the present invention, an ink jet recording head includes a substrate provided with an energy generating element to generate energy used for discharging ink, a discharge port being an aperture from which the ink is discharged, the discharge port utilizing the energy of the energy generating element, a supply port for supplying the ink, and an ink path formed on the substrate to make the discharge port and the supply port communicate with each other, wherein wall members forming the ink path are made of an inorganic material, and a space formed between wall members of adjoining ink paths is filled up with a metal layer.

According to another aspect of the present invention, a manufacturing method of an ink jet recording head, which includes a substrate provided with an energy generating element to generate energy used for discharging ink, a discharge port being an aperture from which the ink is discharged, the discharge port utilizing the energy of the energy generating element, a supply port for supplying the ink, and an ink path formed on the substrate to make the discharge port and the supply port communicate with each other, includes the steps of forming a shape of the ink path on the substrate with a soluble material, coating the shape with an inorganic material to form a coated layer to be wall members of the ink path, forming a metal layer between wall members of adjoining ink paths by plating, forming a discharge port in the coated layer, forming a supply port in the substrate, and removing the shape.

According to the present invention, the metal layer is formed between the wall members of the ink paths which wall members are formed of the inorganic material to moderate the irregularities of the surface of the substrate, and consequently it becomes possible to provide a head that attains the stabilization of discharge. Moreover, the strength of the wall members of the liquid chamber can be increased, and the temperature-rising of the head can be reduced owing to the heat radiation effect of the metal.

Moreover, when the form in which a metal layer is connected with a driver for driving the energy generating element is adopted, wiring resistance can be decreased, and a wiring width, which controls a chip size, can be reduced. Consequently, the miniaturization and the densification of a chip can be attained.

Further features of the present invention will become apparent from the following description of an exemplary embodiment with reference to the attached drawings.

DESCRIPTION OF THE EMBODIMENTS

Figure 1:
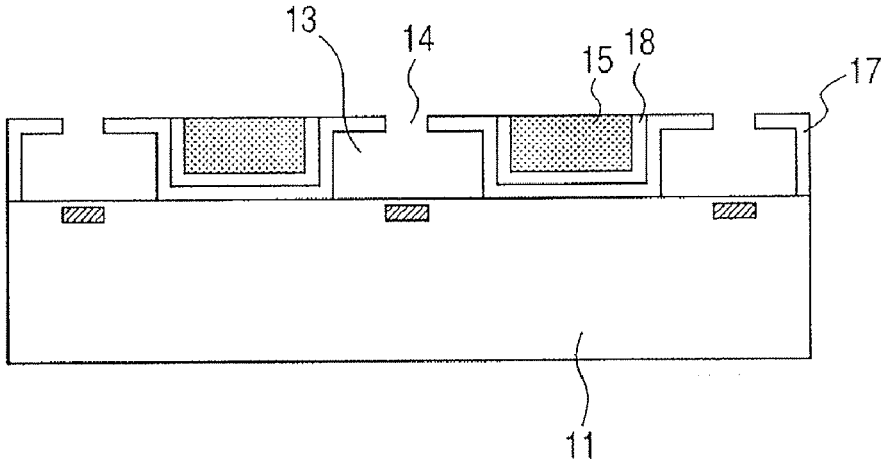
FIG. 1 is a schematic sectional side elevation (viewed at a cut surface with an alternate long and short dash line X1-X2 in FIG. 2) showing the principal part of an example of an ink jet recording head according to the present invention.

An ink jet recording head to which the present invention can be applied is described with reference to the attached drawings.

In addition, some components having the same functions are denoted by the same reference numerals, and their duplicated descriptions are sometimes omitted in the following description.

Figure 2:
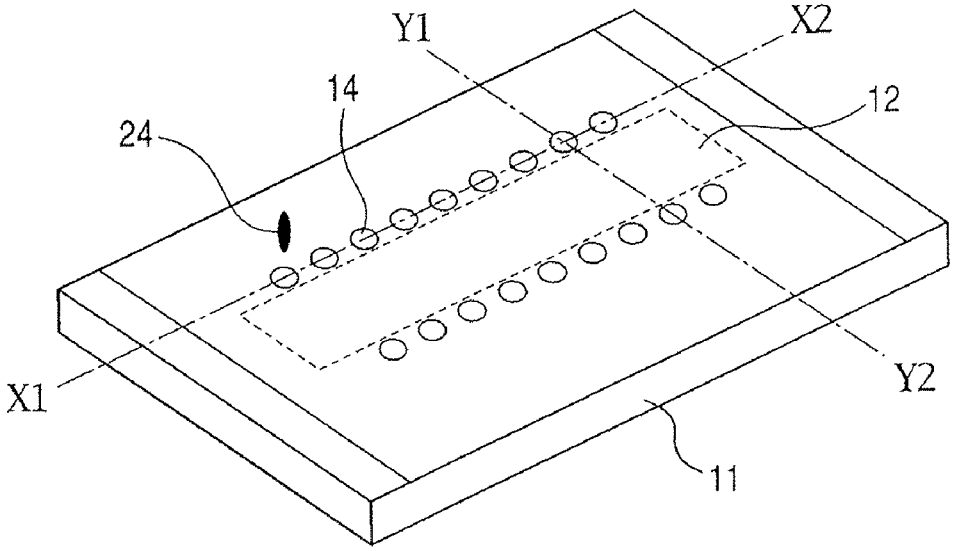
FIG. 2 is a schematic perspective view showing the example of the ink jet recording head according to the present invention.

FIG. 2 is a schematic perspective view showing an ink jet recording head according to an embodiment of the present invention. Moreover, FIG. 1 is a schematic sectional side elevation pertaining to a cross-section cut at a cross-section perpendicular to a substrate through an alternate long and short dash line X1-X2 in FIG. 2, and FIGS. 3A-3J are views showing each step of the manufacturing process of the ink jet recording head.

As shown in FIG. 1, supply ports 12 (FIG. 2) are formed in a substrate 11 so as to penetrate the substrate 11, and ink paths 13 and discharge ports 14 are formed so as to communicate with the supply ports 12. Then, metal layers 15 are formed between the discharge ports 14. Dents between wall members 17, which are made of an inorganic material and form a plurality of the ink paths 13 and the discharge ports 14, are improved by the metal layers 15, and a good discharge state can be maintained.

Figure 4:
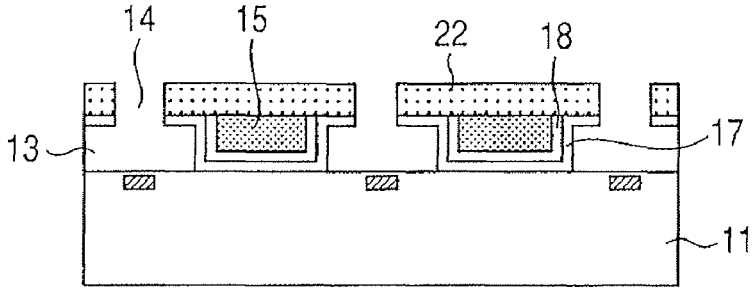
FIG. 4 is a schematic sectional view showing an example of the manufacturing method of an ink jet recording head according to the present invention.

FIG. 4 is a view pertaining to the same surface as that of FIG. 1. In the ink jet recording head shown in FIG. 4, surface protection films 22 are formed on the surface in which the discharge ports 14 are opened. When a water repellant layer or a hydrophilic layer that contains siloxane as the principal component is further added to be formed on the surface protection films 22 for the discharge stability of ink if the surface protection films 22 are made of an inorganic material, the formation of the water repellant layer or the hydrophilic layer is very effective for keeping an adhesion force. Alternatively, when the surface protection film 22 is covered by a metal material, it is possible to obtain a strong surface that does not cause the instability of discharge owing to the dispersion of the wettability of ink and has scratch resistance in some selections of metal and some selections of ink.

In the following, examples of the ink jet recording head and the manufacturing method thereof according to the present invention are shown, and the present invention is further minutely described.

EXAMPLE 1

The process chart of FIGS. 3A, 3B, 3C, 3D, 3E, 3F, 3G, 3H, 3I and 3J is a schematic sectional view at the time of seeing the same surface as that of FIG. 1.

Figure 3A:
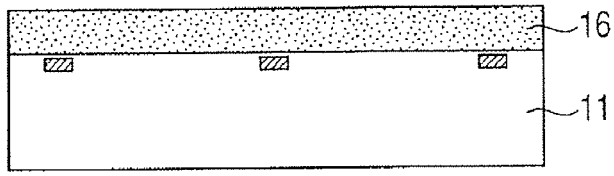
FIGS. 3A, 3B, 3C, 3D, 3E, 3F, 3G, 3H, 3I and 3J are schematic sectional views showing an example of a manufacturing method of an ink jet recording head according to the present invention.

As shown in FIG. 3A, the substrate 11 on which heating resistors 18 as energy generating elements to generate energy to be used for discharging ink were formed was prepared. Next, Al 16 was formed on the substrate 11 to be about 15 μm in thickness by the sputtering method as a material to form the shapes of ink paths made of a removable material.

Figure 3B:
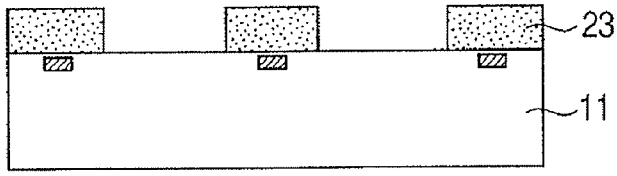

Next, as shown in FIG. 3B, resist was formed on the Al 16 by the photolithographic method, and the Al 16 was etched using the resist as a mask with phosphoric acid to form the shapes 23.

Figure 3C:
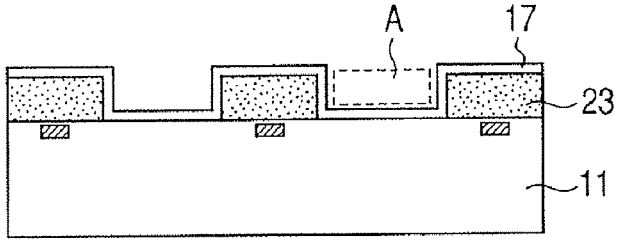

Next, as shown in FIG. 3C, a wall member 17 was formed to be 10 μm in thickness with silicon oxide by the CVD under the condition of about 400° C. using a mono-silane gas as a raw material. At this time, because the wall member 17 grew along the forms of the shapes 23, dent portions were produced in the wall member 17 as a broken-line frame A. The dents existed between the portions of the wall member 17 that became the side walls of the ink paths later. When the dent portions exist on a completed head, the dent portions become a cause of a defect at the time of discharging ink, as described above. Accordingly, a step of forming metal layers in the dent portions was performed at a later step.

Figure 3D:
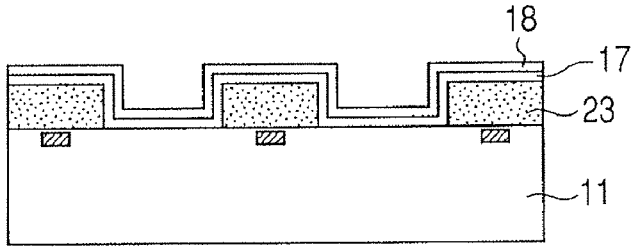

Next, as shown in FIG. 3D, an undercoat layer 18 for plating was formed to be about 100 nm in thickness by the sputtering method using gold as a material.

Figure 3E:
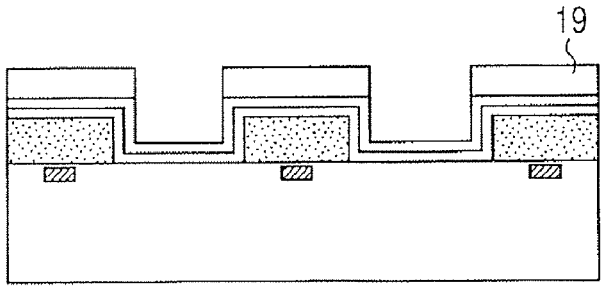
Figure 3F:
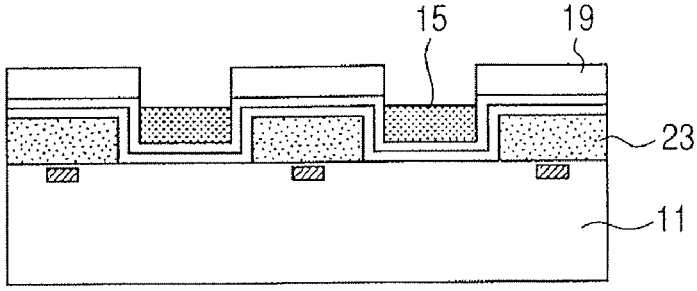

As shown in FIGS. 3E and 3F, resist 19 for plating formation was formed to a predetermined form by the photolithographic method. After that, metal layers 15 were formed to be 15 μm in thickness using a plating solution of gold sulfite using the resist 19 as a mask for electroplating. Thereby, the spaces between portions to become the side walls of the ink paths could be filled up.

Figure 3G:
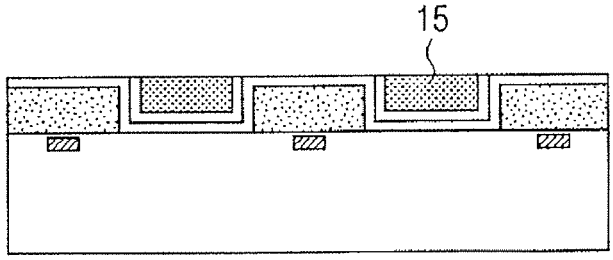

Next, after the removal of the resist, as shown in FIG. 3G, the plating undercoat layers 18 that were situated on the shapes 23 were removed using a mixed liquid of iodine and potassium iodide. By the removal, the surfaces of the shapes 23 and the surfaces of the metal layers 15 were flattened as common surfaces, and the surface irregularities were moderated.

Figure 3H:
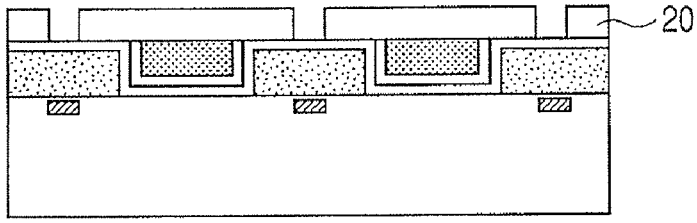

Next, as shown in FIG. 3H, resist 20 used as the mask for forming discharge ports was applied, and was formed to be a predetermined form by the photolithographic method.

Figure 3I:
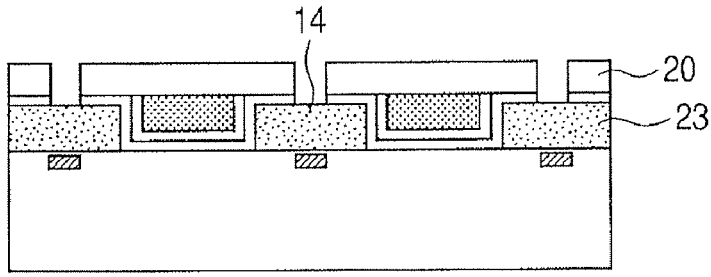

Next, as shown in FIG. 3I, the silicon oxide was etched by the dry etching method using $CF_4$ to form the discharge ports 14.

Figure 3J:
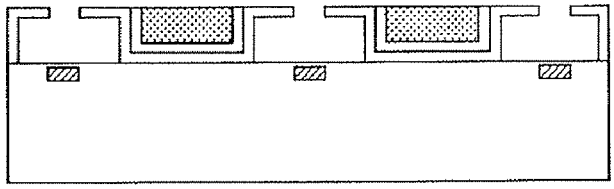

Next, the substrate of Si was subjected to wet etching using tetra methyl ammonium hydroxide (TMAH) (not shown) as an etchant to form supply ports. Moreover, the shape material 16 of Al was dissolved by the TMAH at the same time of forming the supply ports to form the liquid paths 13 and the discharge ports 14 that were connected to the supply ports. After that, resist 21 was removed, and an ink jet recording head as shown in FIG. 3J was completed.

Moreover, although silicon oxide was used as the material to form the wall members 17 in the present example, materials such as silicon nitride, silicon carbide and the like can be used without being especially limited to the silicon oxide as long as the materials have similar ink resistance and the strength capable of securing a steric structure.

The completed substrate had a nozzle structure using an inorganic material and could perform stable ink discharge owing to having no steps between discharge ports on the liquid chambers. Moreover, the gold plating lay open on the surfaces, and the completed substrate had a good heat radiation performance to be suitable for high speed ink discharge.

EXAMPLE 2

As for the present example, a description is given to an example forming surface protection films for protecting the surfaces in which the discharge ports are formed in addition to the structure of the example 1.

As shown in FIG. 3G, the manufacturing process was performed similarly to that of the example 1 until the step of flattening the surfaces of the shapes 23 and the metal layers 15.

A description is given to the steps after the flattening step.

FIGS. 5A, 5B, 5C and 5D are schematic sectional views pertaining to a cross-section similar to that of FIG. 1.

Figure 5A:
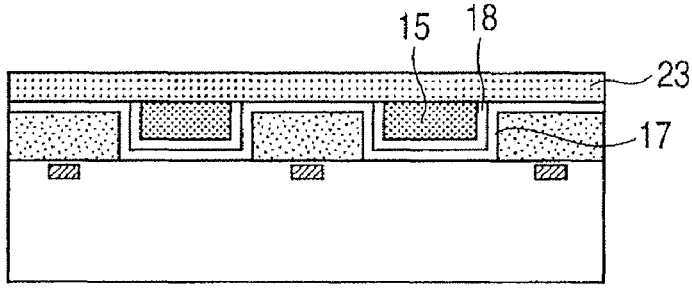
FIGS. 5A, 5B, 5C and 5D are schematic sectional views showing an example of the manufacturing method of an ink jet recording head according to the present invention.

As shown in FIG. 5A, a layer 23 to become the surface protection film 22 was formed on the flattened surface formed of the metal layers 15, the wall member 17 and the undercoat layers 18.

Figure 5B:
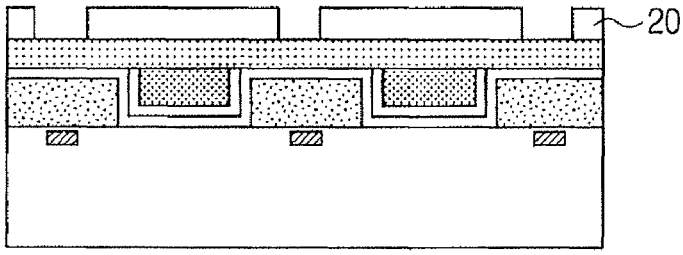

Next, as shown in FIG. 5B, the resist 20 for forming the discharge ports was formed into a predetermined form by the photolithographic method.

Figure 5C:
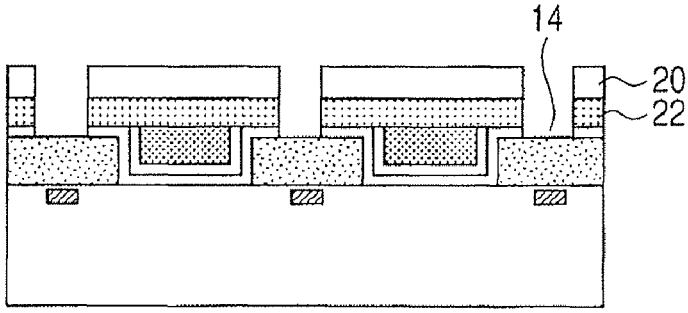

Next, as shown in FIG. 5C, the surface protection films 22 were formed by the dry etching method using $CF_4$, and the wall member 17 was etched to form the discharge ports 14.

Figure 5D:
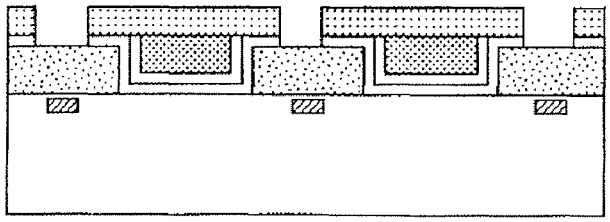

Next, as shown in FIG. 5D, the resist was removed.

The following steps were performed similarly to those of the example 1, and the ink jet recording head as shown in FIG. 4 was completed.

EXAMPLE 3

Figure 6:
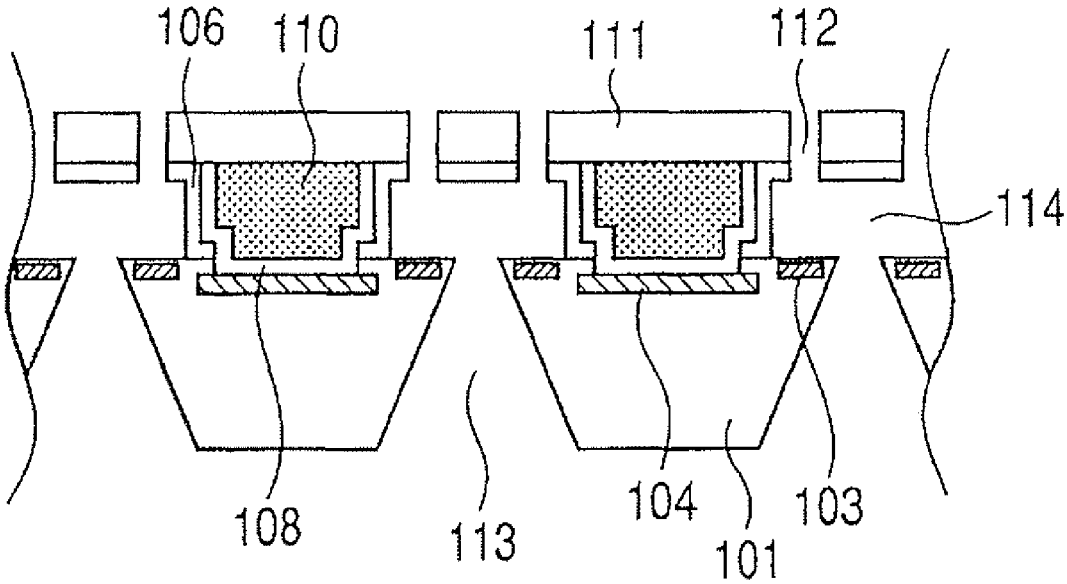
FIG. 6 is a schematic sectional side elevation (viewed at a cut surface with an alternate long and short dash line Y1-Y2 in FIG. 2) showing the example of the ink jet recording head according to the present invention.

FIG. 6 is a schematic sectional view showing the ink jet recording head of example 3 according to the present invention, and is a view pertaining to the cross-section through the line Y1-Y2 in FIG. 2, which cross-section is perpendicular to the substrate. The example 3 is an example in which the metal layers existing between walls of adjacent ink paths are connected to the wiring for driving heating resistors to attain the decrease of electric resistance.

As shown in FIG. 6, there are heating resistors 103 that were built into a substrate 101 in advance, and wiring layers 104 connected to a driver for driving heating resistors 103. Metal layers 110 formed by plating are connected to the wiring layers 104. Moreover, a reference numeral 111 denotes a surface protection layer; a reference numeral 112 denotes a discharge port; and a reference numeral 113 denotes a supply port. Moreover, wall members for forming the metal layers 110 by plating are formed.

Figure 8:
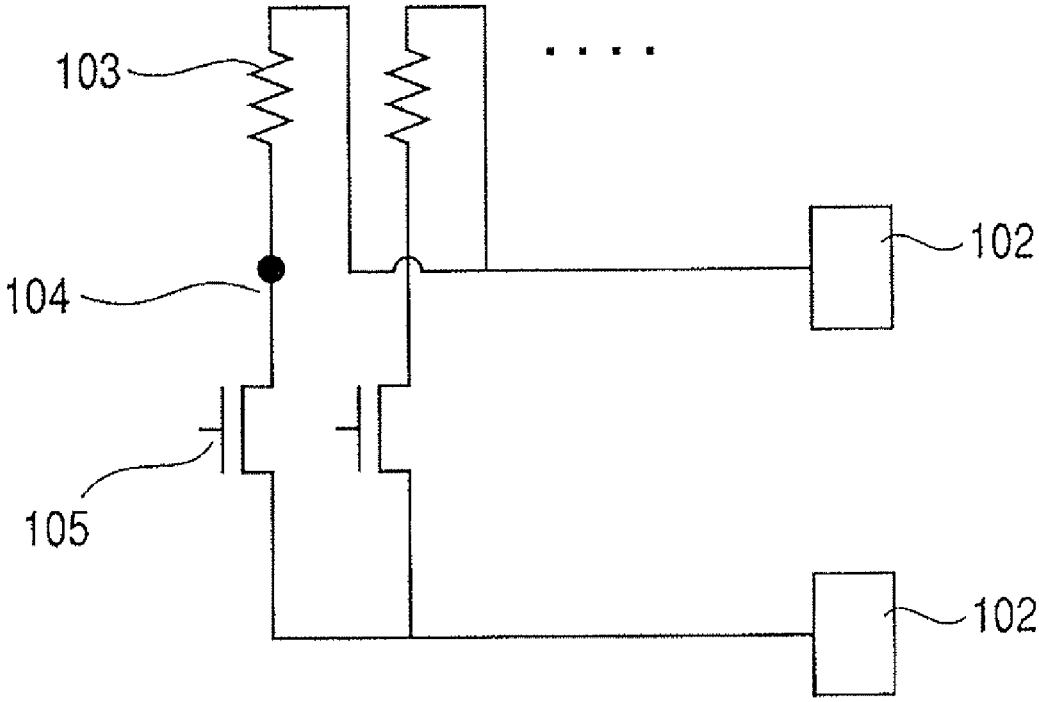
FIG. 8 is an illustrative view of a part of wiring for driving the heating resistors 103 in the substrate.

FIG. 8 is an illustrative view of a part of wiring for driving the heating resistors 103 in the substrate. The heating resistors 103 are connected to a driver 105 through a wiring layer 104. 102 denotes a pad portion through which the circuit is connected to the outside.

A manufacturing method of the ink jet recording head having such a structure is described with reference to FIGS. 7A, 7B, 7C, 7D, 7E, 7F, 7G, 7H, 7I, 7J, 7K, 7L, 7M, 7N and 7O.

Figure 7A:
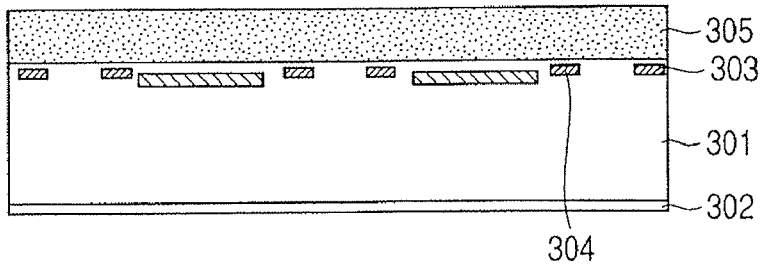
FIGS. 7A, 7B, 7C, 7D, 7E, 7F, 7G, 7H, 7I, 7J, 7K, 7L, 7M, 7N and 7O are schematic sectional views showing an example of the manufacturing method of an ink jet recording head according to the present invention.

As shown in FIG. 7A, heating resistor layers 303 and lower layer wiring layers 304 are formed in a Si substrate 301, and a $SiO_2$ film 302 is formed on the back surface of the Si substrate 301 in advance. Al 305 was formed to be about 15 μm in thickness on the front surface of the Si substrate 301 by the sputtering method as a material that could be eluted later.

Figure 7B:
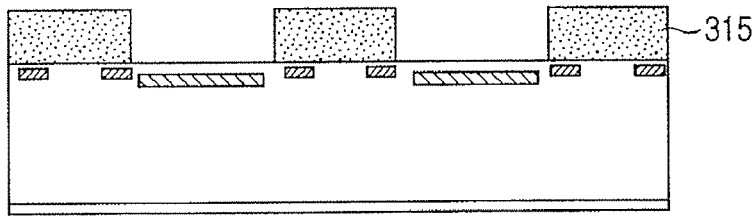

Next, as shown in FIG. 7B, resist was formed by the photolithographic method, and the Al 305 was worked into a desired form by the wet etching method using phosphoric acid to form shapes 315.

Figure 7C:
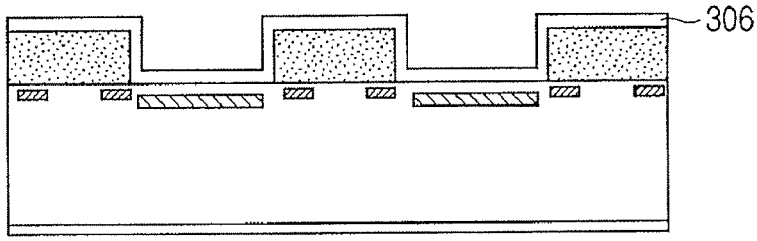

Next, as shown in FIG. 7C, silicon oxide 306 to become ink path walls was formed to be 10 μm in thickness on metal layers 310 and the substrate 301.

Figure 7D:
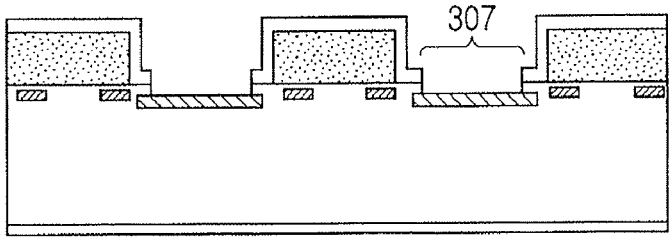

Next, as shown in FIG. 7D, parts of the wall member 306 that contact with the substrate 301 were subjected to dry etching to form aperture portions 307 in order to make it possible to realize the electrical connection with the lower layer wiring 304. Thereby, the wiring layers 304 were exposed.

Figure 7E:
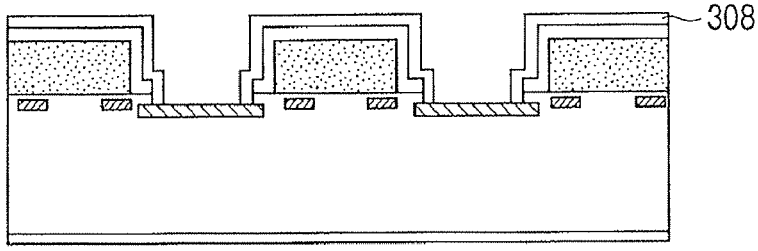

Next, as shown in FIG. 7E, Au that became an undercoat layer 308 at the time of later plating was formed to be 100 nm in thickness by sputtering. At this time, the undercoat layer 308 and the wiring layers 304 were connected with each other.

Figure 7F:
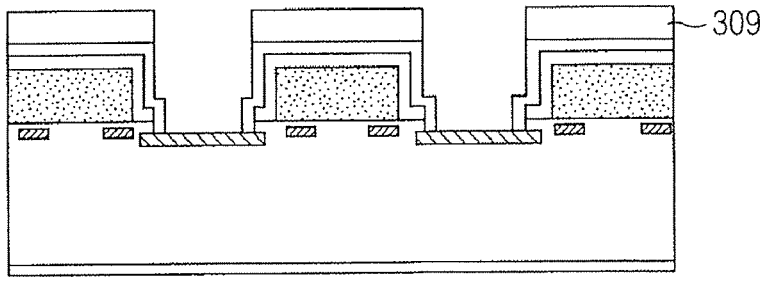

Next, as shown in FIG. 7F, mask resist 309 was formed on the undercoat layer 308.

Figure 7G:
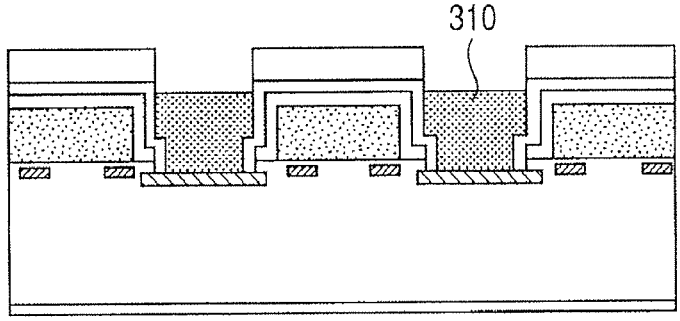

Next, as shown in FIG. 7G, Au plating 310 was formed to be 10 μm in thickness in the regions where the undercoat layer 308 was exposed by a plating solution using gold sulfite using the resist 309 as a mask for the electroplating.

Figure 7H:
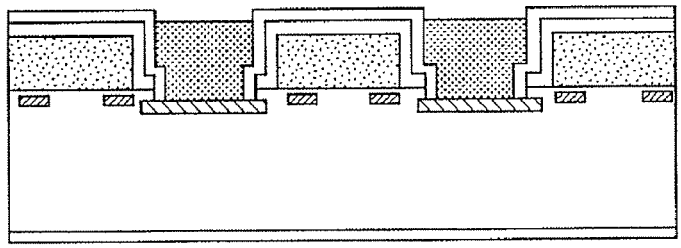

Next, as shown in FIG. 7H, the resist 309 was peeled off.

Figure 7I:
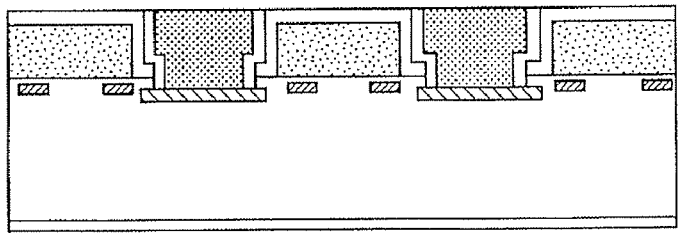

Next, as shown in FIG. 7I, the undercoat layer 308 and the metal layers 310 were etched using an Au etchant of a mixed solution of iodine and potassium iodide so that the front surfaces might be flat. Thereby, the irregularities of the front surfaces in which discharge ports were formed were moderated.

Figure 7J:
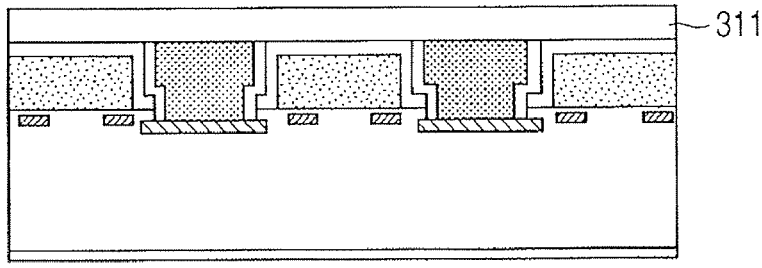

Next, as shown in FIG. 7J, a surface protection layer 311 made of P—SiN was formed.

Figure 7K:
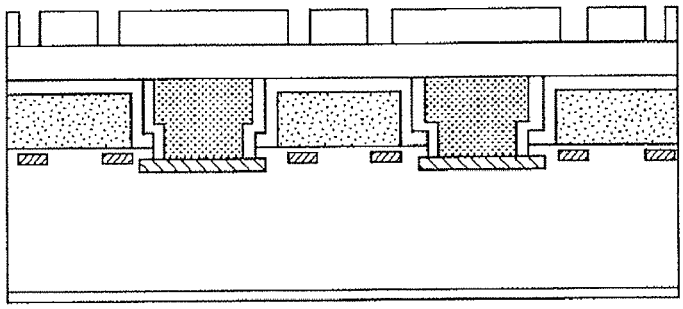

Next, as shown in FIG. 7K, mask resist for forming the discharge ports was formed.

Figure 7L:
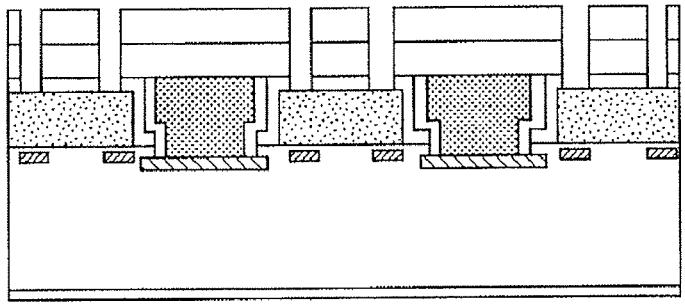

Next, as shown in FIG. 7L, silicon oxide 306 was etched by the dry etching using $CF_4$ using the surface protection layer 311 and the resist as a mask.

Figure 7M:
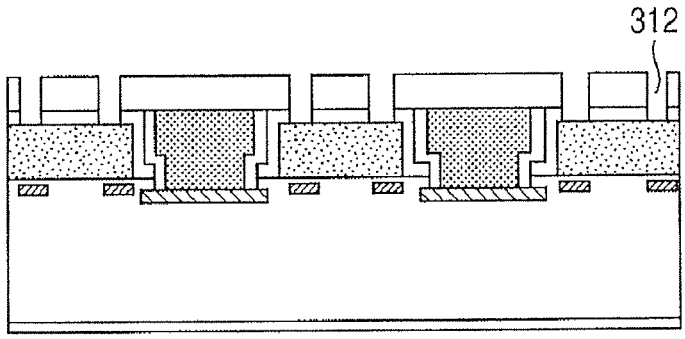

Next, as shown in FIG. 7M, the positive resist was peeled off to form the discharge ports 312.

Figure 7N:
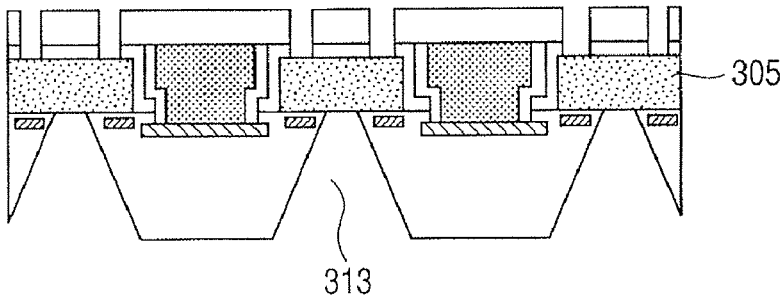

Next, as shown in FIG. 7N, the substrate 301 was etched to form supply ports 313.

Figure 7O:
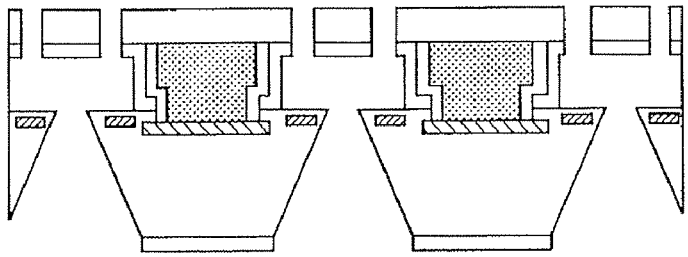

Lastly, the shapes 305 were removed, and an ink jet recording head was completed as shown in FIG. 7O.

When it was performed to discharge ink using the ink jet recording head produced in such a way, stable and high speed discharge could be performed. It could be considered that the reason was that ink did not stay because the spaces between the wall members forming the ink paths were filled up. Moreover, it could be also considered that the reason was that the heat radiation characteristic was good by the Au plating and the ink jet recording head was suitable for high speed ink discharge. Moreover, because the metal layers 310 could be used as common wiring, wiring resistance could be decreased, and the energy loss of the wiring portion could be decreased to suppress the temperature rising of the head.

EXAMPLE 4

Surface processing layers having a water repellent or hydrophilic characteristic were formed on the surface protection film of the ink jet recording head of example 3, and an ink jet recording head was assembled similarly to the example 1. An evaluation was performed using these heads similarly to that in the example 3.

It was confirmed that discharge was stable similarly to the example 3. Moreover, the discharge was confirmed to be stable over a longer period. It could be considered that the reason was that the surface processing layers were formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-344366, filed Nov. 29, 2005, which is hereby incorporated by reference herein in its entirety.

What is claimed is:

1. An ink jet recording head comprising:

a substrate provided with energy generating elements to generate energy used for discharging ink;

discharge ports from which the ink is discharged;

a supply port formed in said substrate for supplying the ink; and ink paths formed on said substrate to make said discharge ports and said supply port communicate with each other, wherein ink path wall members forming said ink paths are made of an inorganic material, metal is filled between wall members of adjacent ink paths, a surface protection film of an insulating material coats a surface in which said discharge ports are formed and said metal, and a surface processing layer is formed on said surface protection film.

2. The ink jet recording head according to claim 1, wherein said metal is connected to drivers for driving said energy generating elements through through-holes formed in said wall members.

3. The ink jet recording head according to claim 1, wherein said surface protection film is made of an inorganic material.

4. The ink jet recording head according to claim 1, wherein said surface protection film is made of a metal material.

5. An ink jet recording head according to claim 1, wherein said surface processing layer exhibits hydrophilicity.

6. An ink jet recording head according to claim 1, wherein said surface processing layer exhibits water-repellancy.

* * * * *